US005961927A

United States Patent [19]

Isaacs et al.

[11] Patent Number: 5,961,927

[45] Date of Patent: Oct. 5, 1999

[54] WORKING PIPETTOR STATION

[75] Inventors: Benjamin S. Isaacs, Tewsbury; Rachel C. Isaacs, Tewksbury; Katrina M. Brown, Leicester; Joshua N. Isaacs, Tewksbury; Jennifer L. Ray, Bolton; Suzanne P. McKenzie, Cambridge; Heather E. Hughes, Brookline, all of Mass.

[73] Assignee: Formatech, Inc., Lowell, Mass.

[21] Appl. No.: 08/771,531

[22] Filed: Dec. 23, 1996

[51] Int. Cl.[6] ..... B01L 9/00

[52] U.S. Cl. ..... 422/104; 422/100; 203/523; 211/60.1; 211/71.01

[58] Field of Search ..... 422/100, 102, 422/104; 73/864.01, 864.14; 206/523, 524; 211/71, 60.1, 64

[56] References Cited

U.S. PATENT DOCUMENTS

| | | | |
|---|---|---|---|
| 4,518,076 | 5/1985 | Feisel et al. | 198/648 |
| 4,791,060 | 12/1988 | Chandler | 435/296 |
| 4,836,374 | 6/1989 | Hutchins et al. | 206/373 |
| 4,859,610 | 8/1989 | Maggio | 436/518 |
| 4,929,427 | 5/1990 | Guala | 422/100 |
| 4,944,924 | 7/1990 | Mawhirt et al. | 422/104 |
| 5,035,861 | 7/1991 | Grandone | 422/64 |
| 5,316,178 | 5/1994 | Garber | 222/3 |
| 5,356,006 | 10/1994 | Alpern et al. | 206/363 |
| 5,384,103 | 1/1995 | Miller | 422/310 |
| 5,570,794 | 11/1996 | Drower | 211/89 |
| 5,615,782 | 4/1997 | Choe | 211/70.6 |
| 5,624,849 | 4/1997 | Thomas et al. | 436/180 |

*Primary Examiner*—Long V. Le

[57] ABSTRACT

The invention relates to a working pipettor station comprising an exterior frame and an interior support. The pipettor station is used in conjunction with a pipettor which is in use (i.e., with a pipettor tip attached) and requires temporary and secured positioning or storage. Optionally, an apron can be an additional component of the working pipettor station.

9 Claims, 8 Drawing Sheets

WORKING PIPETTOR STATION

Scientists and technologists working in research and clinical laboratories employ a wide variety of instruments and devices in the performance of their duties. One such device is a pipette, which is used for the transfer of various volumes of liquids, such as biological fluids and dissolved chemicals.

There are, essentially, two types of pipettes. First, traditional pipettes which transfer relatively larger volumes of liquid and are usually composed of variously shaped glass tubes with measurement increments typically in milliliter or tenths of milliliter volumes. The capacity of these pipettes ranges from one milliliter to one hundred milliliters or more.

Secondly, in recent decades, more sophisticated pipettes, more commonly known as pipettors, have been developed to transfer remarkable small volumes of liquid with measurement increments as low as one tenth of a microliter and requiring, obviously, greater standards of precision and accuracy. Due to the high degree of required precision, usually these pipettors have more lower capacity and require periodic calibration. The pipettors are comprised of a plunger type instrument activated by thumb movement of the hand which permits the displacement and withdrawal of a volume of liquid from its source into a plastic, disposable pipettor tip where the liquid is retained until it is dispensed. These pipettors can be single channel pipettors or multiple channel pipettors comprised of typically eight or twelve channels.

When not in operation, these more precise pipettors are typically stored in a laboratory bench drawer or pipettor holder comprised of a rack which holds the pipettor or pipettors in a vertical position. In operation, scientists and technologists use these pipettors repeatedly and for significant periods of time. Often a pipettor user will need to interupt his or her pipetting schedule for various reasons without the need of changing the pipettor tip, including getting other solutions to be pipetted, placing a culture into an incubator, or simply, answering the telephone. It is usually inappropriate or inconvenient to temporarily store a pipettor that is in use (i.e. with a pipettor tip attached) in a laboratory bench drawer or vertical holder. Frequently, a pipettor user with a pipettor in use, who needs to interupt his or her pipetting, will lay the pipettor at the edge of a laboratory bench with the pipettor tip extending over the edge of the bench to avoid contamination. In this position, the pipettor is vulnerable to being struck by an arm or a lab coat of a person walking by, which can cause the pipettor to fall to the floor or at the very least be displaced from its temporary position. When a sensitive instrument such as this type of precision pipettor is jarred as a result of falling to the floor, it often needs to be re-calibrated before it can be used again reliably, and this can cause a great inconvenience to the pipettor user, as well as potential financial cost should the pipettor become damaged and require replacement. In addition, if the pipettor tip becomes contaminated, replacement of the tip will also be required.

A device or apparatus which circumvents the problems mentioned above associated with the temporary storage of a pipettor in use that provides a safe and convenient area to temporarily store a pipettor in use, would be particularly useful for scientific and technical personnel in research and clinical laboratories.

SUMMARY OF THE INVENTION

The present invention relates to a working pipettor station comprising an exterior frame and an interior support. The pipettor station is used in conjunction with a pipettor which is in use (i.e. with a pipettor tip attached) and requires temporary and secured positioning or storage. Optionally, an apron can be an additional component of the working pipettor station.

The exterior frame is comprised of a base plate and a right wall, a left wall, a posterior wall and an anterior wall. Each wall is fixedly secured to the base plate, as well as, to each adjacent wall, forming a cup-like structure. The exterior frame with its cup-like structure has an opening for the insertion and retention of the interior support. The surface of the base plate of the exterior frame which contacts a laboratory bench-top can be comprised of a non-skid or skid-resistance providing material. This material can provide for secure positioning of entire station to its placement on the laboratory bench-top.

The interior support is comprised of material with the composition, shape and dimensions which allow the support to be inserted, retained and and retracted from the exterior frame. The interior support has a bottom portion which is in contact with the base plate of the exterior frame when the interior support is retained in the frame. In addition, the interior support has a top portion which is available for contact with a pipettor. This top portion can have a plurality of partitions and cut-outs for the separation and positioning of one or more pipettors.

The advantages of the present invention over the prior art include the characteristics of providing an area on a laboratory bench where a pipettor in use can be temporarily positioned or stored. A pipettor positioned on the working pipettor station is secured and protected from inadvertant or accidental displacement. As such, precision pipettors that are temporarily stored on the working pipettor station will avoid accidental falls from laboratory benchtops and avoid the need for frequent re-calibration and potential replacement. In addition, the pipettor can be positioned such that the pipettor tip is free from contact with other articles and/or substances which can cause contamination of the pipettor tip, and thus, require its replacement with a new, uncontaminated pipettor tip. In general, the working pipettor station offers a safe and secure environment for pipettors that are in use and require temporary storage.

BRIEF DESCRIPTION OF THE DRAWINGS

FIG. One (1) is a diagramatic representation of a working pipettor station used in conjunction with an apron and providing temporary storage of a pipettor in use.

FIG. Two (2) is a diagramatic representation of a cross-section of a working pipettor station providing temporary storage of a pipettor in use and illustrates the interior support contained within the exterior frame with the base plate, the anterior wall, the posterior wall, partitions and cut-out areas for the positioning of pipettors in use.

Figure 1:
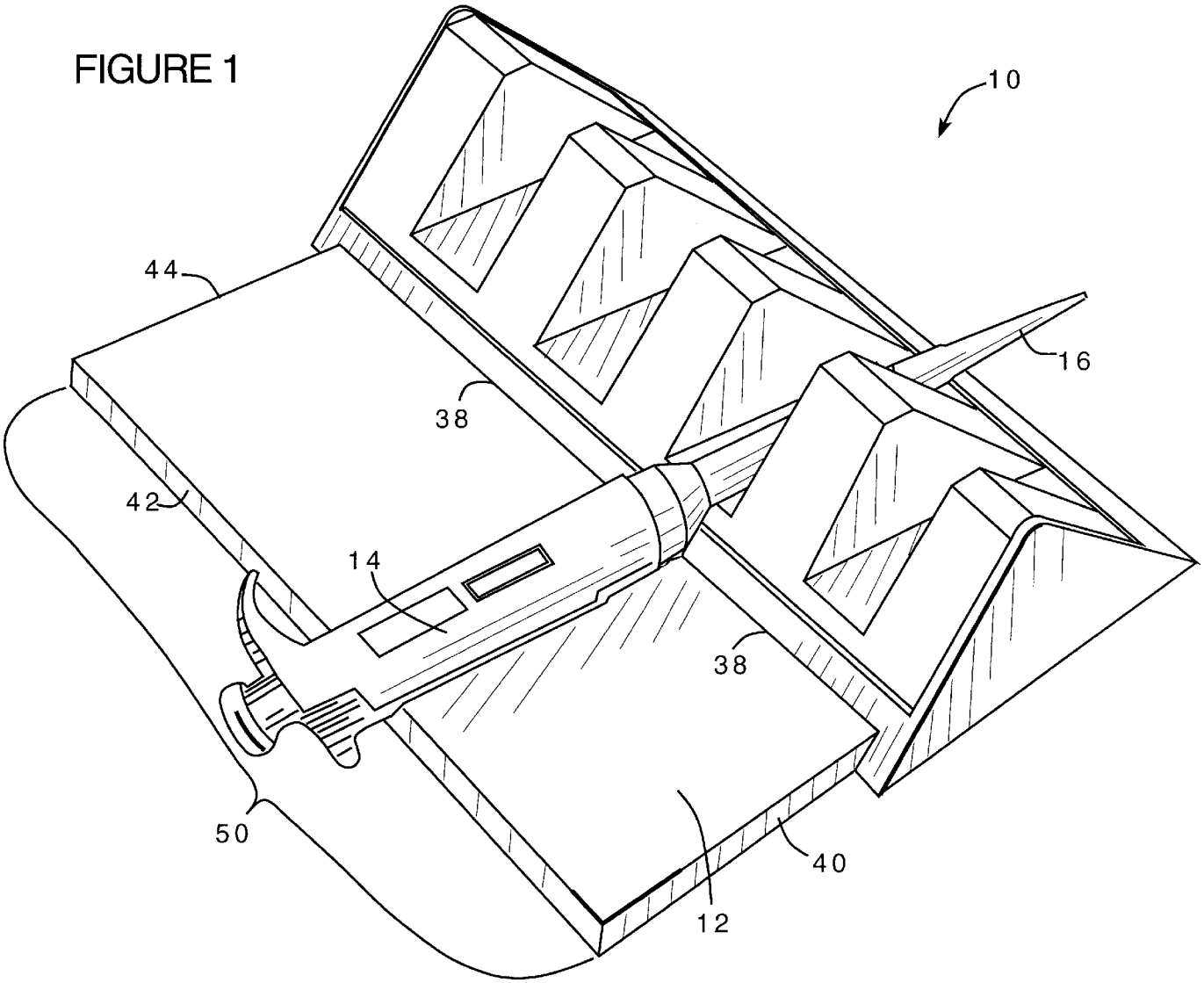
Figure 2:
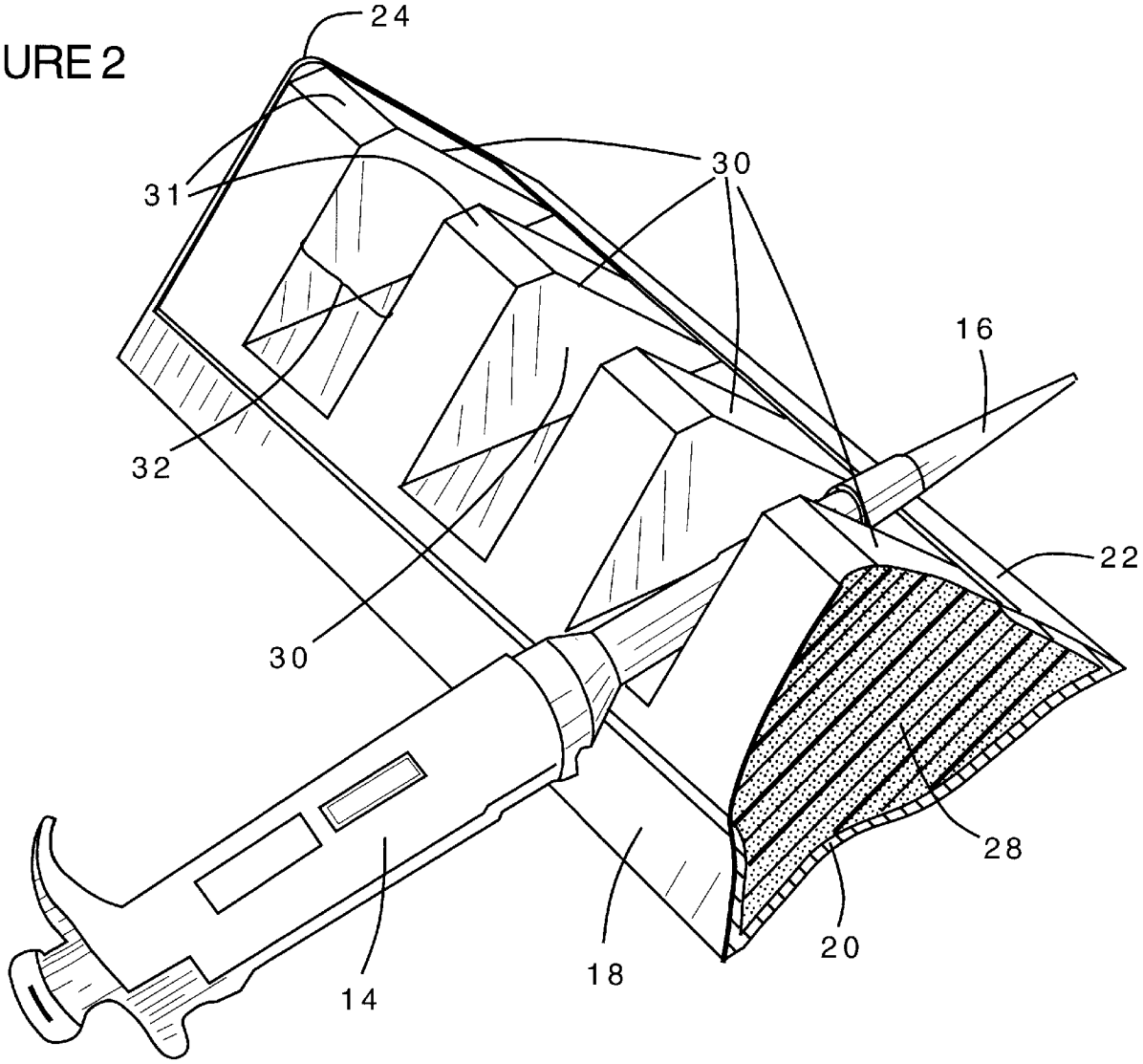
Figure 3:
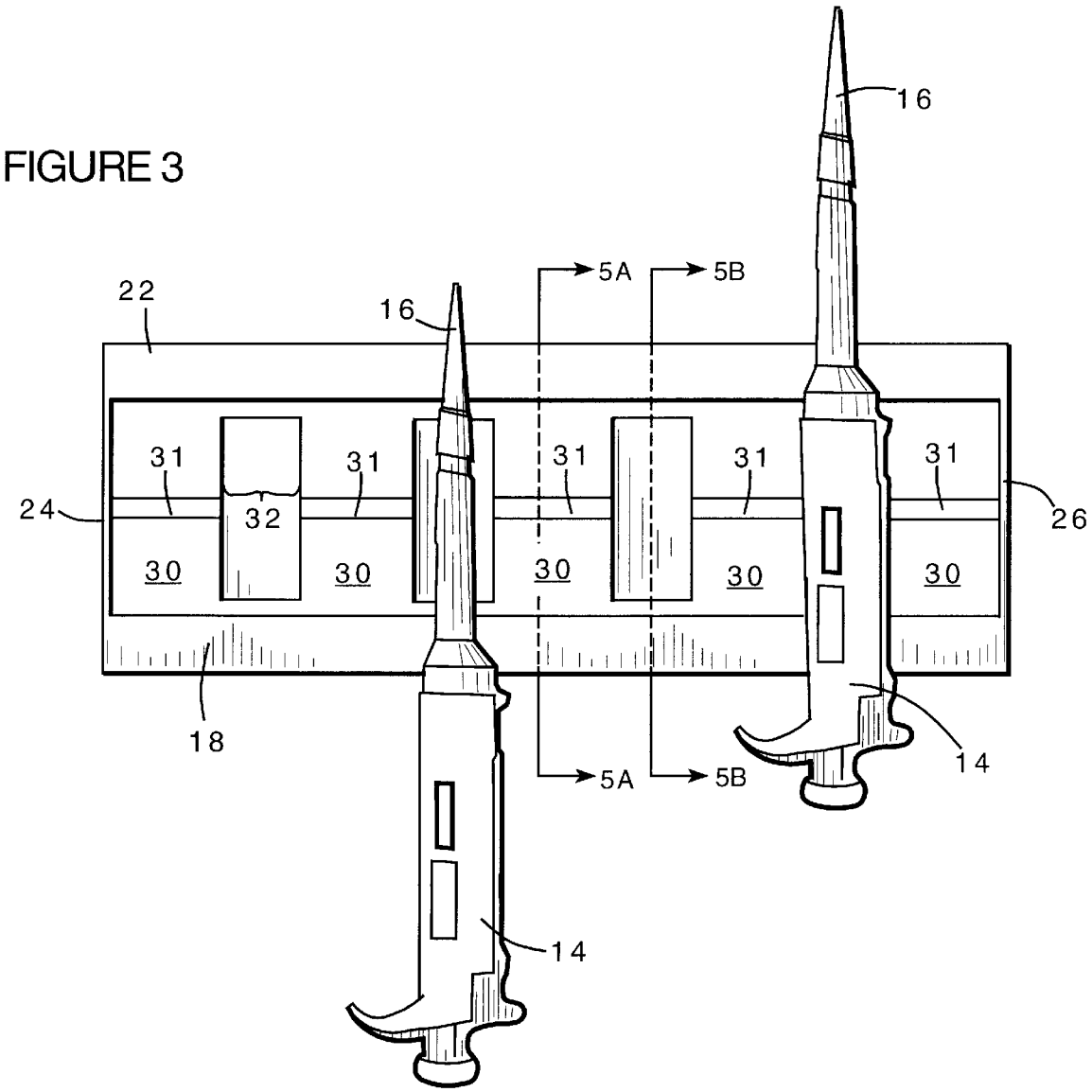
Figure 4:
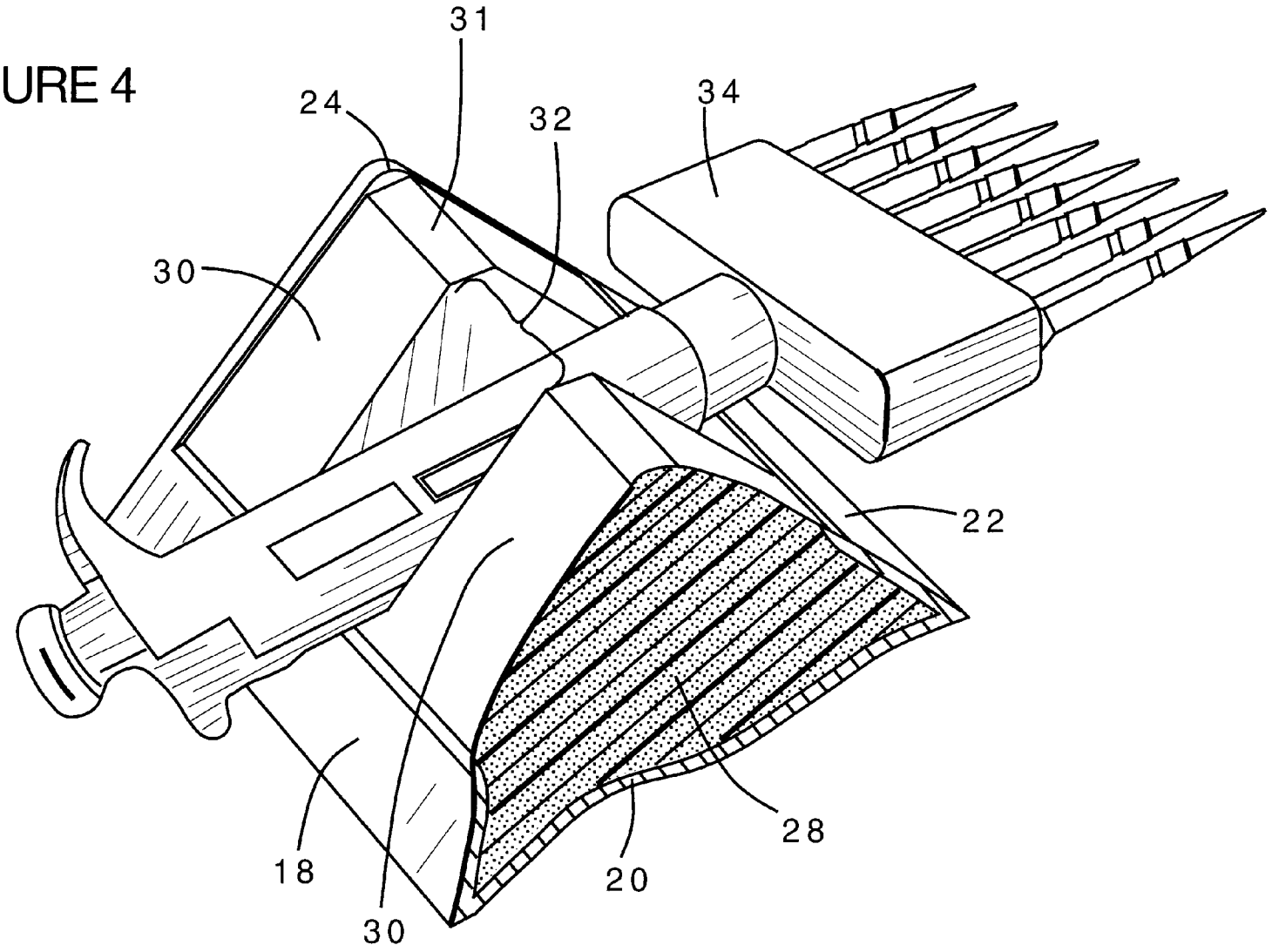
Figure 5B:
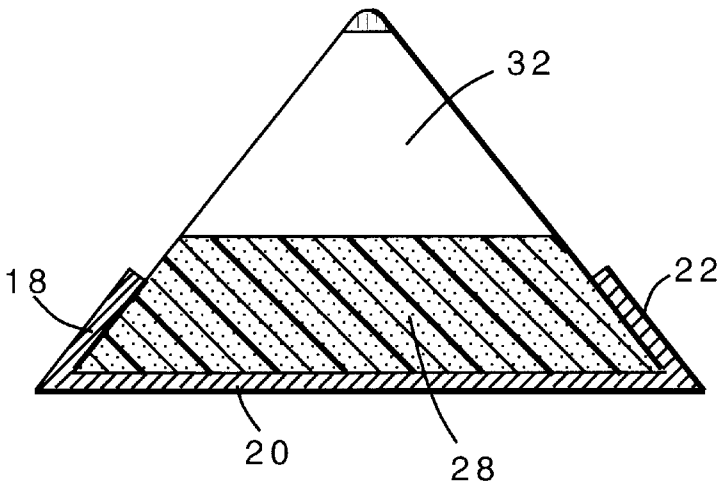
Figure 5A:
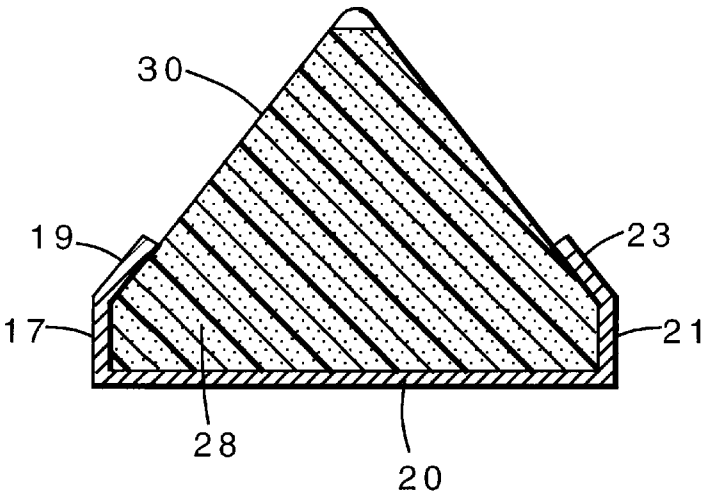
Figure 6A:
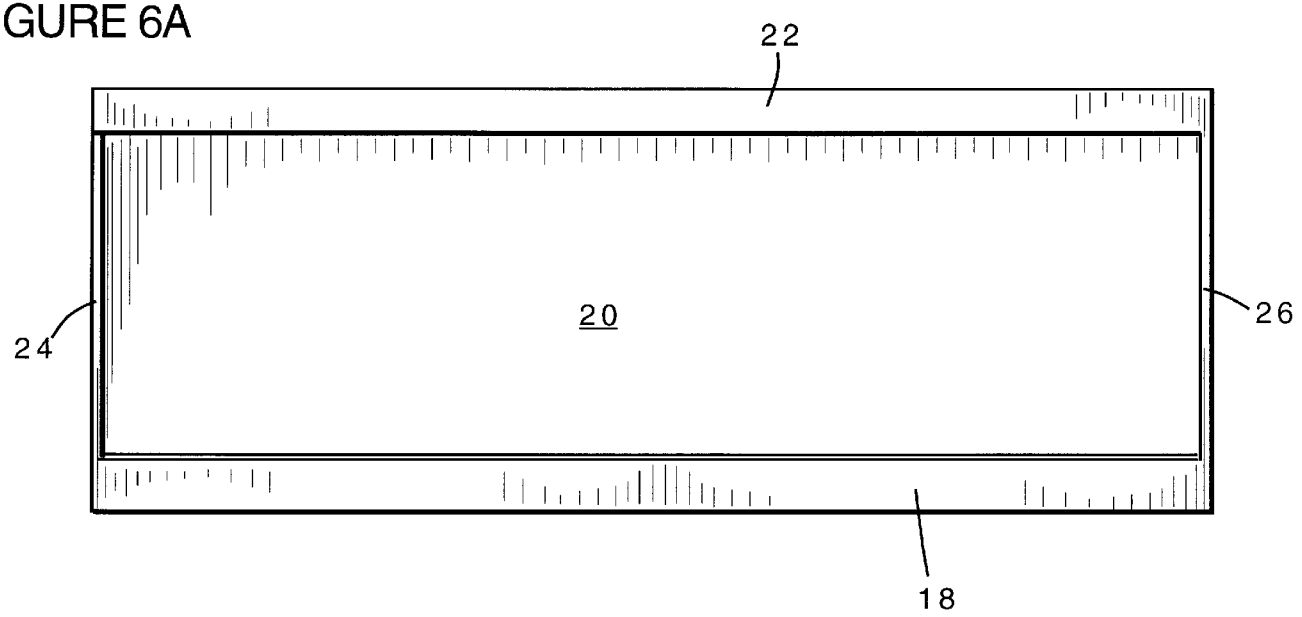
Figure 6B:
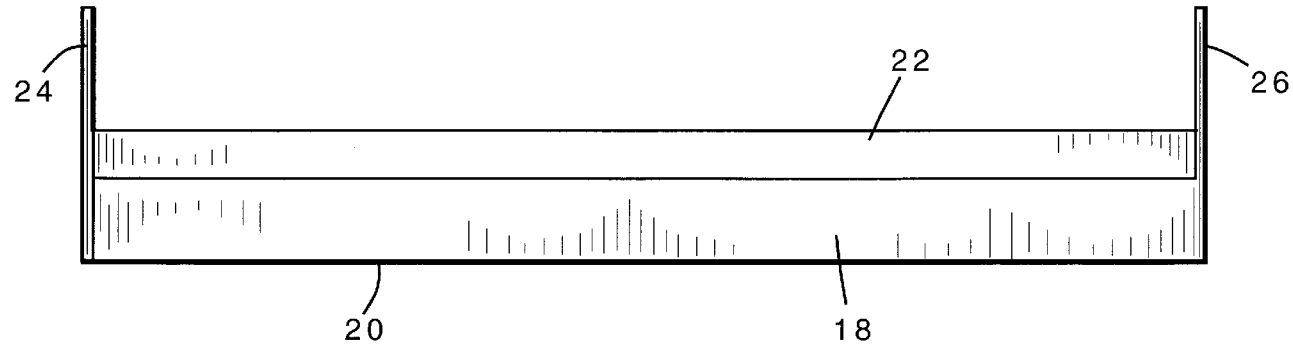
Figure 7:
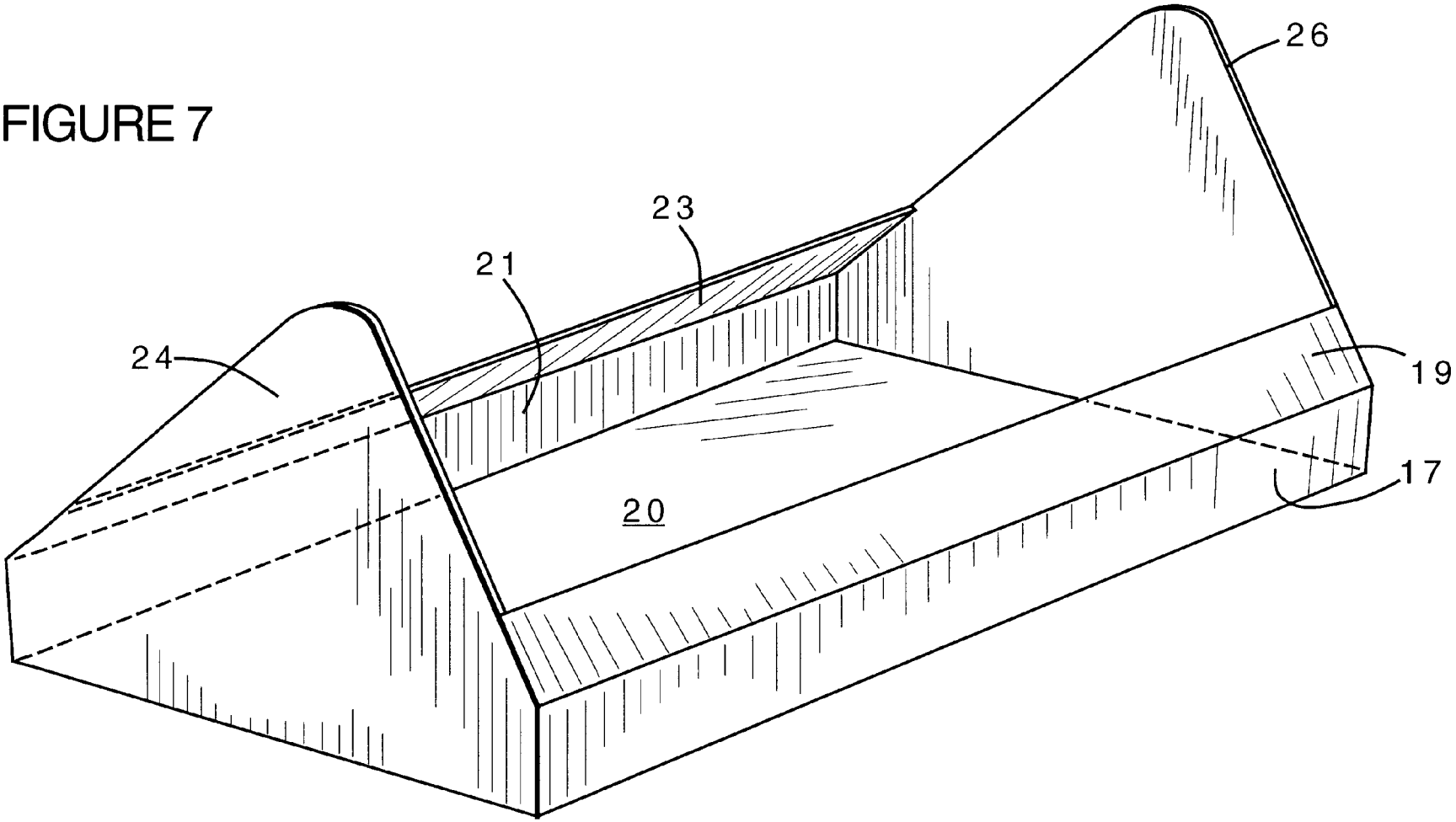

FIG. Three (3) is a diagramatic representation of an overhead view of a working pipettor station, illustrating two positions in which pipettors can be stored, as well as the structural features of the working pipettor station.

FIG. Four (4) is a diagramatic representation of a cross-section of a working pipettor station accommodating the temporary storage of a multichannel pipettor.

FIG. Five A (5) is a diagramatic representation of a working pipettor station in cross-section at an area along the station where top portion of the interior support has been cut-out to allow for the positioning and temporary storage of a pipettor; and illustrating one configuration of the exterior frame where the anterior and posterior walls are fixedly secured to the base plate at right angles (i.e. 90 degree angles) initially and then angle inward to provide for secure retainment of the interior support.

FIG. Five B (5B) is a diagramatic representation of a working pipettor station in cross-section at an area along the station where top portion of the interior support remains to allow for the partitioning of pipettors; and illustrating one configuration of the exterior frame where the anterior and posterior walls are fixedly secured to the base plate at angles less than 90 degrees but also angle inward to provide for secure retainment of the interior support.

FIG. Six (A) (6A) is a diagramatic representation of an overview of an exterior frame; illustrating the base plate, the left and right side walls and the anterior and posterior walls, all fixedly secured.

FIG. Six B (6B) is a diagramatic representation of a front view of an exterior frame, illustrating the base plate, the left and right side walls and the anterior and posterior walls, all fixedly secured.

FIG. Seven (7) is a diagramatic representation of a three dimensional view of an exterior frame illustrating its components, all fixedly secured.

FIG. Eight (8) is a diagramatic representation of a three dimensional view of an exterior frame illustrating its, components all fixedly secured, where the bottom portion of the anterior wall absent for the insertion of an apron that is contiguous with the interior support.

DETAILED DESCRIPTION OF THE INVENTION

The present invention relates to a working pipettor station comprising an exterior frame and an interior support. The pipettor station is used in conjunction with a pipettor which is in use (i.e. with a pipettor tip attached) and requires temporary and secured positioning or storage. Optionally, an apron can be an additional component of the working pipettor station.

Definitions

The following terms are herein defined for the purpose of describing the invention.

FIXEDLY SECURED can be defined as affixing, attaching or molding an object to another. In the context of the present invention, the base plate, the right and left side walls and the anterior and posterior walls of the exterior support are affixed, attached or molded securely to one another to create a cup-like structure with an opening for the insertion, retention and retraction of an interior support. The components (i.e. base plate and walls) of an exterior frame made by an injection molding process are fixedly secured together by the molding process, resulting in a unitary cup-like structure. In addition, the apron component of the present invention can be directly affixed or attached to the interior support, or separate from the interior support.

OPENING (including open) can be defined as an area through which unobstructed access to the interior of a structure is gained; or an unobstructed entrance and exit, not shut or closed. In the context of the present invention, the exterior frame has an area through which the interior support with or without an attached apron can be 1) accessed and removed or 2) inplaced for containment. In addition, the exterior frame can have an opening along the length of the anterior wall to permit the insertion and/or passage of the apron of the present invention.

INSERTION can be defined as the introduction into or between the body of a structure. In the context of the present invention, the interior support can be inserted into the exterior frame. In addition, the apron can be inserted into the opening in the anterior wall. Also, pipettors can be inserted into the cut-outs and between the partitions of the interior support for positioning and storage.

RETENTION can be defined as being held in place or in position. In the context of the present invention, the interior support is retained in the exterior frame. When retained in this position, interior support is considered to be in its operative position.

RETRACTION can be defined as being withdrawn from a place or position. In the context of the present invention, the interior support can be withdrawn from the exterior frame, leaving the exterior frame as a single component. When withdrawn and separated from the exterior frame, both the interior support and the exterior frame can be cleaned and/or sterilized. Alternatively, the interior support can be replaced with a new support.

PARTITION can be defined as something that divides or separates, one of the parts or sections of a whole. In the context of the present invention, the interior support contains partitions or columns which divide and separate the cut-out areas for positioning and storage of pipettors.

CUT-OUT can be defined as an area of an object which is removed from the object as a whole. In the context of the present invention, a cut-out refers to the area(s) of the interior support which have been removed or left to create an area(s) where a pipettor can be temporarily positioned and stored.

SEPARATION can be defined as a means of division or a means of providing an intervening space. In the context of the present invention, separation refers to the combined effect of the partitions and cut-outs of the interior support which create distinct and separate areas for the positioning and storage of pipettors. In addition, the relationship of the exterior frame and the interior support is that they are distinct structures that are separable.

POSITIONING can be defined as being placed in a location. In the context of the present invention, positioning refers to the placement of pipettors on cut-outs and between partitions of the interior support. Once positioned, the pipettors can remain in position as a means of storage.

ABSORPTIVE can be defined as a property of a substance or structure that takes in through or as through pores or interstices. In the context of the present invention, the interior support can be comprised of a material which absorb liquids associated with pipettor tips.

FLEXIBLE can be defined as a property of a substance or structure which is capable of being flexed and thus is pliant and adaptable. In the context of the present invention, the interior support can be comprised of a material which is pliant and adaptable such that the interior support can be easily inserted, retained and retracted to and from the exterior frame.

DURABLE can be defined as the property of a sustance or structure which is capable of withstanding wear and tear and is long lasting in its original form. In the context of the present invention, the exterior support can be comprised of material which can withstand deformation from wear and tear, including but not limited to autoclaving which is a sterilization process, achieved by being subjecting a structure to strong, pressurized steam heat. Structures meeting this property can be various metals and plastics.

SKID-RESISTANCE PROVIDING MATERIAL can be defined as any material which can provide traction. Traction is defined as frictional resistance between two surfaces. In the context of the present invention, the skid-resistance providing material provides traction between the pipettor station and a laboratory bench-top.

Working Pipettor Station

The working pipettor station is comprised of two main components, the exterior frame and interior support. The apparatus is used in conjunction with precision pipettors. Alternatively, the working station can be comprised of a third component, namely an apron, attached to or separate from the interior support.

Exterior Frame

The exterior frame is a structure including but not limited to the following characteristics:

A) Cup-Like Structure: the exterior frame must have a structure which permits the insertion, retention and retraction of the interior support. As such, the structure of the exterior frame must provide for an opening, but also provide a means for containment; similar to the characteristics of a cup. The area of the exterior frame which contacts a laboratory bench-top (e.g. base plate) can be comprised of skid-resistance providing material.

B) Dimensions: the exterior frame must have dimensions suitable for placement on a laboratory bench top. The length of the frame can be from 0.25 inches to 10 feet, more preferably within the range of 1.0 to 20.0 inches and most preferably between 2 and 12 inches. The width of the exterior frame can be from 0.5 to 12.0 inches, more preferably from 1.0 to 8.0 inches, and most preferably from 2.5 to 4.5 inches. The height of the exterior frame can be from 0.2 to 3.0 inches, more preferably from 0.5 to 2.0 inches, and most preferably from 0.5 to 1.5 inches.

C) Shape: The overall shape of the exterior frame can be any one of a variety of shapes, including but not limited to a rectangle or a square, with hard or rounded edges. A rectangular shape provides for greater length and greater area for positioning of multiple pipettors.

D) Composition: the exterior frame can be comprised of any substance which allows for the above characteristics. Preferably, the composition is of a durable nature, such as metal or plastic.

Interior Support

The interior support is a structure including but not limited to the following characteristics:

A) Overall Structure: the interior support is comprised of two contiguous portions, a lower portion and an upper portion. When the interior support is in an operational position (i.e. retained in the exterior frame) the lower portion is in contact with, but still retractable from the base plate of the exterior frame. The upper portion is available for contact with and positioning of pipettors in the cut-outs between the partitions.

B) Dimensions: The interior support must have physical dimensions in length, width and height similar to the exterior frame, such that the dimensions are compatible with the capability of the interior support to be inserted into, retained by and retracted from the exterior frame. The upper portion of the interior support must have at least one cut-out and two partitions to allow the positioning of one or more pipettors. The distance of the cut-out(s) between partitions can be manufactured to various distances depending upon the size of the pipettor(s) to be stored. Typically, the distance between partitions of a cut-out to accomodate a single channel pipettor can be from 1.0 to 2.0 inches, and more preferably from 1.25 to 1.50 inches. The distance for a multi-channel pipettor can be greater.

C) Shape: The overall shape of the interior shape should be consistent with the overall shape and dimensions of the exterior frame.

D) Composition: The interior support can be comprised of any substance which allows the above characteristics providing the composition has a texture which will hold a pipettor in place once it is positioned in a cut-out. For example, a sponge-like material is suitable in that it provides for a soft and absorptive, but stable positioning of a pipettor.

Apron

The apron is a structure which abutts the anterior wall of the exterior frame and provides additional contact surface area for a pipettor to be positioned and stored. Alternatively, the apron can be contiguous with the interior support and exit the exterior frame from an opening in its anterior wall. Typically, the handle segment of a pipettor is placed on the apron while the opposite end of the pipettor is positioned in a cut-out between partitions of the upper segment of the interior support. The length of the apron should correspond to the length of the exterior frame and the width should be sufficient to accomodate the length of the handle segment of a pipettor. The composition of the apron can be the same as the composition of the interior support, providing a soft and stable position for a pipettor. In addition, there can be plastic base on which the apron can lie, wherein the base can have a top and a bottom portion. The top portion contacts the apron and the bottom portion contacts the laboratory bench-top and can be comprised of a skid-resistance providing material.

Construction of the components of the invention which are comprised of plastic or metal can be achieved by mass manufacturing using an injection molded process by one of ordinary skill in the art. Components of the invention comprised of a sponge-like or absorptive material can be achieved by mass manufacturing using a dye cut process by one of ordinary skill in the art.

Preferred Embodiment of the Invention

The preferred embodiment of the present invention relates to a working pipettor station used in conjunction with precision pipettors. The preferred embodiment and its use is illustrated in FIGS. 1 thru 8. The working pipettor station (#10) is placed on a laboratory bench top and used to position and temporarily store pipettors that are in use (i.e., with a pipettor tip (#16) attached), both single channel (#14) and multichannel pipettors (#34).

The exterior frame can be comprised of a base plate (#20), an left side wall (#24), a right side wall (#26), an anterior wall (#18) and a posterior wall (#22), all fixedly secured to create a cup-like structure with an opening to allow the insertion, retention and retraction of the interior support. In typical use, the working stations 8 to 10 inches in length, 2.5 to 4.5 inches in width, with the side walls being 2 to 4 inches in height and the anterior and posterior wall 0.25 to 1.00 inches in height. The thickness of the base plate and the walls is between is 0.1 and 0.3 inches.

Figure 8:
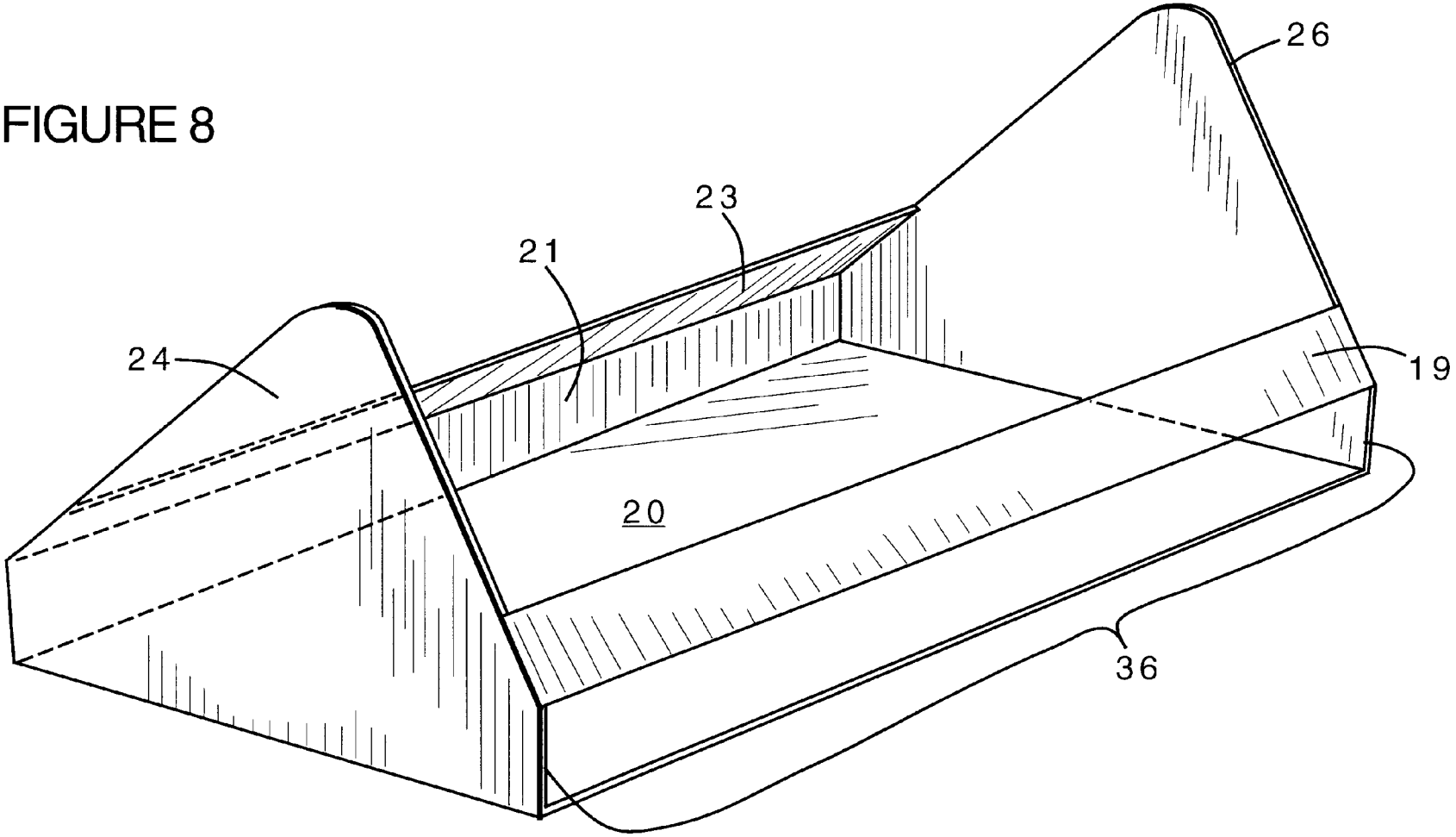

Alternatively, the anterior and posterior walls can be comprised of two segments, a first segment (#17 and #21)

which is fixedly secured to the base plate and is positioned at a 90 degree angle from the base plate and a second segment (#19 and #23) which is fixedly secured to the first segment (#17) and angles inward at less than 90 degrees. Also, another embodiment can provide for an opening (#36) in the anterior wall where the first segment (#17) is missing as illustrated in FIG. 8.

The interior support (#28) is comprised of a sponge-like material and is dye-cut to the length, width, and height conformations of the exterior frame. The top portion of the interior support provides for partitions (#30) and cut-out (#32), combined to give areas where the pipettors can be positioned. The tops of the partitions can be champered (#31).

An apron (#12) also can be provided wherein it is comprised of a sponge-like material with a width or 0.1 to 0.2 inches (#40) and a length (#50) comparable to the length of the exterior frame. The apron abutts (#38) the anterior wall of the exterior frame (#18) or it can be contiguous with the interior support and extend through the opening (#36) of an alternative embodiment of the anterior wall as illustrated in FIG. 8. The surface area of the apron is large enough to accomadate the handle portion of a precision pipettor.

Equivalents

Those skilled in the art will recognize, or be able to ascertain using no more than routine experimentation, many equivalents to the specific embodiments of the invention described specifically herein. Such equivalents are intended to be encompassed in the scope of the following claims.

We claim:

1. A working pipettor station consisting of:

an exterior frame, said frame having a base plate and a right side wall, a left side wall, a posterior wall and an anterior wall, said walls being fixedly secured to said base plate and to each wall's respective adjacent walls, said base plate and said walls forming an open structure for inserting and retaining an interior support wherein said interior support: a) is comprised of a material having a composition with shape and dimensions which fills the open structure of said frame and allow said support to be inserted, retained and retracted from the open structure of said frame; and b) said interior support has a bottom portion in contact with said base plate of said frame when retained in said frame and a top portion contacting and positioning one or more pipettors.

2. A working pipettor station consisting of:

an exterior frame, said frame having a base plate and a right side wall, a left side wall, a posterior wall and an anterior wall, said walls being fixedly secured to said base plate and to each wall's respective adjacent walls, said base plate and said walls forming an open structure for inserting and retaining an interior support wherein said interior support: a) is comprised of a material having a composition with shape and dimensions which fills the open structure of said frame and allow said support to be inserted, retained and retracted from the open structure of said frame; and b) said interior support has a bottom portion in contact with said base plate of said frame when retained in said frame a top portion having a plurality of partitions and cut-outs contacting, separating and positioning multiple pipettors.

3. A working pipettor station consisting of:

an exterior frame, said frame having a base plate and a right side wall, a left side wall, a posterior wall and an anterior wall, said walls being fixedly secured to said base plate and to each wall's respective adjacent walls, said base plate and said walls forming an open structure for inserting and retaining an interior support wherein said interior support: a) is comprised of a material having a composition with shape and dimensions which fills the open structure of said frame and allow said support to be inserted, retained and retracted from the open structure of said frame; and b) said interior support has a bottom portion in contact with said base plate of said frame when retained in said frame a top portion having a plurality of partitions and cut-outs contacting, separating and positioning multiple pipettors.

4. A working pipettor station of claim 1 wherein said station further consists of an apron positioned adjacent and outside to said anterior wall of said exterior frame for the sole purpose of supporting a handle of a pipettor, wherein said apron can be separate from or contiguous with the interior support.

5. A working pipettor station of claim 4 wherein said anterior wall has an opening along the length of the wall to allow the insertion and passage of an apron which is contiguous with the interior support but positioned outside the anterior wall of said exterior frame.

6. A working pipettor station of claim 1 wherein the exterior frame consists of inflexible material.

7. A working pipettor station of claim 6 wherein the inflexible material consists of plastic.

8. A working pipettor station of claim 1 wherein the interior support consists of durable material.

9. A working pipettor station of claim 1 wherein the interior support consists of absorptive material.

* * * * *